US005215544A

United States Patent [19]

Karakawa et al.

[11] Patent Number: 5,215,544

[45] Date of Patent: Jun. 1, 1993

[54] PROCESS FOR MODIFYING AN ANIMAL HAIR

[75] Inventors: Tadashi Karakawa, Aichi; Satoshi Konagaya, Kani; Tetuo Hirose, Gifu; Takashi Kondo, Kyoto, all of Japan

[73] Assignee: Kurashiki Boseki Kabushiki Kaisha, Okayama, Japan

[21] Appl. No.: 637,842

[22] Filed: Jan. 4, 1991

[30] Foreign Application Priority Data

Jan. 6, 1990 [JP] Japan ..... 2-844

[51] Int. Cl.[5] ..... D06M 13/26; D06M 13/34

[52] U.S. Cl. ..... 8/128.3; 8/128.1; 8/127.5; 8/127.51

[58] Field of Search ..... 8/128.1, 127.5, 127.51, 8/127.6, 619, 128.3, 611, DIG. 3

[56] References Cited

U.S. PATENT DOCUMENTS 2,895,286 7/1959 O'Connell ..... 8/128.1

4,030,883 6/1977 Vaeken et al. ..... 8/128.1

*Primary Examiner*—Prince Willis, Jr.
*Assistant Examiner*—John F. McNally
*Attorney, Agent, or Firm*—Armstrong, Westerman, Hattori, McLeland & Naughton

[57] ABSTRACT

According to the present invention, an animal hair fiber can significantly be modified by fixing the supercontraction of the fiber which is a disadvantage in itself. The process for modifying the animal hair fiber according to the present invention comprises pretreating the animal hair fiber with a cleaving reagent for crosslinkage of the fiber and then treating the pretreated fiber with an supercontracting reagent. Furthermore, the process for preparing a bulky wool yarn according to the present invention comprises treating an mixed yarn with the supercontracting reagent, said mixed yarn consisting of the pretreated animal hair fiber with the cleaving reagent for crosslinkage of the fiber and a non-pretreated animal hair fiber.

6 Claims, No Drawings

PROCESS FOR MODIFYING AN ANIMAL HAIR

BACKGROUND OF THE INVENTION

The present invention relates to a process for modifying an animal hair fiber.

It is known that although the animal hair fiber contracts to 30–40% of its original length when it is immersed in liquid ammonia, said fiber returns nearly to its original length if it is immersed in the water. For this reason, a technique to utilize industrially this supercontracting phenomenon of the animal hair fiber is not yet established.

SUMMARY OF THE INVENTION

The present invention was carried out in order to modify the animal hair fiber by taking advantage of the supercontracting phenomenon of the fiber which is a disadvantage in itself.

The present invention relates to a process for modifying an animal hair fiber which comprises pretreating the animal hair fiber with a cleaving reagent for crosslinkage of the fiber and then treating the pretreated fiber with an supercontracting reagent.

According to another aspect of the present invention, bulky wool yarn is provided which is prepared by a process comprising treating an mixed yarn with the supercontracting reagent, said mixed yarn consisting of the pretreated animal hair fiber with the cleaving reagent for crosslinkage of the fiber and a non-pretreated animal hair fiber.

DETAILED EXPLANATION OF THE INVENTION

Although wool, kashmir, angora, mohair and the like are exemplified as the animal hair fiber used in the present invention, wool is preferred in particular.

As the cleaving reagent for crosslinkage of the animal hair fiber, thiols such as thioglycolic acid, ammonium salt thereof, alkylmercaptans, mercaptoalcohols and the like, sulfites reducing reagents such as sodium bisulfite, monoethanolamine sulfite, monoethanolamine bisulfite and the like, chlorinating reagents such as chlorine water, sodium hypochlorite and the like, and oxidizing reagents such as hydrogen peroxide, persulfuric acid, potassium permanganate, peracetic acid and the like are exemplified. Thioglycolic acid and ammonium salt thereof are particularly preferred.

Although the conditions for pretreating animal hair fiber with the aforesaid cleaving reagent depend on the kinds of animal hair fiber and the cleaving reagent to be employed, desired bulkiness of the yarn and the like and are not restricted, the pretreating conditions where thioglycolic acid or ammonium salt thereof is used are as follows:

Concentration of the cleaving reagents; 0.3–0.5 mol/l
Bath ratio; 1:10–1:20 by weight of fiber to cleaving reagent
Treating temperature; 40°–45° C.
Treating time; 10–20 minutes A penetrating reagent is preferably used in the aforesaid pretreatment in order to cleave disulfide bond of the fiber effectively. Tergitol TMN which is commercially available from Union Carbide Co. Ltd. and the like are exemplified as the penetrating reagent. The amounts of the penetrating reagent to be used are usually 0.1–0.5 g/l.

The pretreated animal hair fiber is washed sufficiently with water, dried and then subjected to a treatment with the supercontracting reagent.

Although liquid ammonia, ethylene glycols and the like are exemplified as the supercontracting reagent employed in the present invention, liquid ammonia being preferred in particular.

Although the conditions for treating the pretreated animal hair fiber with the supercontracting reagent depends on the kinds of animal hair fiber and the supercontracting reagent to be employed, desired bulkiness of the yarn and the like and are not restricted, the treating conditions where liquid ammonia is used are as follows:

Concentration of the supercontracting reagent; undiluted liquid ammonia
Bath ratio; 1:20–1:40 by weight of fiber to supercontracting reagent
Treating temperature; below boiling point under atmospheric pressure
Treating time; within one minute The treated animal hair fiber with the supercontracting reagent is washed with water, subjected to a treatment with a suitable neutralizing reagent such as acetic acid and the like and then subjected to an appropriate post-treatment.

The treated animal hair fiber with the neutralizing reagent is subjected to a steaming treatment, treated with, for example, hydrogen peroxide solution and the like in order to remove the remaining reducing components, washed with water and then dried.

The modified animal hair fiber prepared in accordance with a series of aforementioned treating processes is particularly useful for a material of bulky light weight clothing because said modified fiber contract to 30–40% of its original length.

Bulky wool yarn can be prepared by a process which comprises blending the aforementioned pretreated animal hair fiber with the cleaving reagent and non-pretreated animal hair fiber and then treating the obtained mixed yarn with the supercontracting reagent. When the bulky mixed yarn consisting of the pretreated animal hair fiber and non-pretreated animal hair fiber is immersed in a solution the supercontracting reagent, supercontraction of the former occurs in preference to that of the latter because disulfide bond of the former is cleaved and intermolecular combination is weakened. Therefore the supercontraction of the latter can be controlled by adjusting properly the immersing conditions of the mixed yarn in the solution of the supercontracting reagent.

The bulky wool yarn can therefore be obtained by subjecting the mixed yarn to the treatment with the supercontracting reagent because the non-pretreated animal hair fiber expands outwardly under the influence of stress caused by the supercontraction of the pretreated fiber which is contiguous to the non-pretreated fiber.

Although the blending ratio of the pretreated animal hair fiber to non-pretreated animal hair fiber and the treating conditions of the mixed yarn with the supercontracting reagent may be chosen depending on the kinds of the supercontracting reagent and the animal hair fiber to be employed, desired bulkiness of the mixed yarn and the like and are not restricted, said ratio and treating conditions for ordinary woven and knitted goods and the like in the case where liquid ammonia is used are as follows:

Blending ratio; pretreated animal hair fiber 20–30% non-pretreated animal hair fiber 80–70%
Treating temperature; below boiling point under atmospheric pressure
Treating time; within one minute A post-treatment, of the aforesaid treated mixed yarn may be carried out in the same manner as that of the animal hair fiber described above. It is convenient to carry out said post-treatment in a continuous process.

Fiber structure of the animal hair is supported by many disulfide bonds (—SS—) and strong hydrogen bonds. Although the animal hair supercontracts if a large percentage of the hydrogen bonds is released with swelling, it has a tendency to return to its original length through deswelling caused by washing with water while intermolecular combination by disulfide bonds exists. However, if disulfide bonds are cleaved previously by reductive or oxidative cleaving reagent which does not damage the animal hair fiber, the supercontraction of the fiber can be fixed because the intermolecular combination becomes weak and the ability of the fiber to return to its original length is reduced.

According to the present invention, animal hair fiber can significantly be modified by fixing the supercontraction of the fiber which is a disadvantage in itself. Furthermore, bulky wool yarn which is particularly useful for material yarn of bulky lightweight clothing can be prepared by utilizing the process for modifying the animal hair fiber according to the present invention.

The present invention will be illustrated by the following example.

EXAMPLE 1

A degreased wool was immersed in an aqueous solution of ammonium thioglycolate (0.5 mol/l) and then dried. An mixed yarn was prepared by blending 30% of this reduced wool and 70% of nonreduced wool.

After immersion in liquid ammonia under atmospheric pressure for 30 seconds, the mixed yarn contracted to ca. 25% of its original length, said contraction being attributable to supercontraction of the reduced fiber. In other words, the bulky wool yarn was obtained by subjecting the mixed yarn to the treatment with liquid ammonia because the nonreduced fiber expands outwardly under the influence of external force caused by the supercontraction of the reduced fiber which is contiguous to the nonreduced fiber. The wool yarn did not return to its original length and bulkiness thereof was retained when it was subjected to hydrothermal treatment such as dyeing and the like.

Wool top was immersed in the bath containing 0.5 mol/l of thioglycolic acid and 0.05 g/l of the penetrating reagent Tergitol TMN which is commercially available from Union Carbide Co. Ltd.).

The immersing conditions of the wool top are as follows:
pH of the bath; 7
Temperature of the bath; 40° C.
Bath ratio; 1:10 by weight of fiber to bath
Immersing time; 10 minutes The immersed wool top was drawn up from the bath, washed with water and then dried. The mixed yarn was prepared by blending the pretreated wool top (20%) and non-pretreated wool top.

The mixed yarn (8.0 m count of 3 twisted yarns) was immersed in the bath containing liquid ammonia under unstressed condition for 20 seconds. The immersed mixed yarn was drawn up from the bath, washed with flowing water immediately, treated with acetic acid until pH of the mixed yarn becomes 7 and then steamed continuously for 5 minutes by means of steamer.

The steamed mixed yarn was treated with hydrogen peroxide (0.1 mol/l) at 50° C. for 5 minutes to neutralize the remained reducing component. The bulky wool yarn (6.9 m count of 3 twisted yarns) was obtained by washing the treated yarn with water and then drying the washed mixed yarn.

The apparent thickness of the bulky wool yarn is equal to that of the yarn (5m count of 3 twisted yarns) prepared by spinning only untreated wool top. The both yarns were dyed by means of a jet hank dyeing machine. Two sweaters whose size and form are the same each other were knitted using the both dyed yarns independently by means of a knitting machine for domestic use under the same condition. Although the apparent thicknesses of the two sweaters were equal each other, remarkable weight difference was observed between the both. The weight of the sweater knitted by using the bulky wool yarn according to the present invention was 255 g. On the other hand, the weight of the sweater knitted by using untreated wool yarn was 340 g.

We claim:

1. A process for modifying an animal hair fiber which comprises pretreating the animal hair fiber with a cleaving reagent for crosslinkage of the fiber, treating the pretreated fiber with a supercontracting reagent and then removing the supercontracting reagent from the supercontracted fiber, wherein said cleaving reagent is selected from the group consisting of ammonium salt of thioglycolic acid and sodium bisulfite, and wherein said supercontracting reagent is liquid ammonia, and wherein the animal hair fiber is wool, cashmere, angora or mohair.

2. A process as claimed in claim 1, wherein the supercontracted fiber with liquid ammonia is treated with a neutralizing reagent, and then washed with water.

3. A process as claimed in claim 2, wherein the neutralizing reagent is acetic acid.

4. A process as claimed in claim 1, wherein the pretreated fiber is treated with ammonia with a bath ratio of from 1:20 to 1:40 by weight of fiber to ammonia at a treating temperature of below the boiling point of liquid ammonia under atmospheric pressure and treating time is within one minute.

5. A process for preparing a bulky wool yarn which comprises treating a mixed yarn with a supercontracting reagent and then removing the supercontracting reagent from the supercontracted mixed yarn, said mixed yarn consisting of animal hair fiber selected from the group consisting of wool, cashmere, angora or mohair which has been pretreated with a cleaving reagent for crosslinkage of the fiber and non-pretreated animal hair fiber selected from the group consisting of wool, cashmere, angora and mohair, wherein said cleaving reagent is selected from the group consisting of ammonium salt of thioglycolic acid and sodium bisulfite, and wherein said supercontracting reagent is liquid ammonia.

6. A process as claimed in claim 5, wherein the mixed yarn consists of 20–30% of the pretreated animal hair fiber and 80–70% of the non-pretreated animal hair fiber.

* * * * *